US007971532B1

(12) United States Patent
Olson et al.

(10) Patent No.: US 7,971,532 B1
(45) Date of Patent: Jul. 5, 2011

(54) MICROELECTROMECHANICAL SYSTEMS IGNITION SAFETY DEVICE

(75) Inventors: David A. Olson, Chesapeake Beach, MD (US); Daniel L. Jean, Odenton, MD (US); Gerald R. Laib, Olney, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 123 days.

(21) Appl. No.: 12/319,912

(22) Filed: Dec. 15, 2008

(51) Int. Cl.
*F42C 15/34* (2006.01)

(52) U.S. Cl. ..... 102/254

(58) Field of Classification Search ..... 102/222, 102/254, 256
See application file for complete search history.

(56) References Cited

U.S. PATENT DOCUMENTS

| | | | | | |
|---|---|---|---|---|---|
| 4,483,250 | A * | 11/1984 | Thurston et al. | ..... | 102/254 |
| 5,269,223 | A * | 12/1993 | Mattsson et al. | ..... | 102/210 |
| H1366 | H * | 11/1994 | Bickes et al. | ..... | 102/202.5 |
| 5,705,767 | A * | 1/1998 | Robinson | ..... | 102/231 |
| 6,167,809 | B1 * | 1/2001 | Robinson et al. | ..... | 102/235 |
| 6,173,650 | B1 * | 1/2001 | Garvick et al. | ..... | 102/202.5 |
| 6,216,445 | B1 | 4/2001 | Byers et al. | | |
| 6,431,071 | B1 | 8/2002 | Hodge et al. | | |
| 6,568,329 | B1 | 5/2003 | Robinson | | |
| 6,622,629 | B2 | 9/2003 | Hodge et al. | | |
| 6,761,116 | B2 | 7/2004 | Daoud | | |
| 6,964,231 | B1 * | 11/2005 | Robinson et al. | ..... | 102/235 |
| 7,007,606 | B1 * | 3/2006 | Maurer et al. | ..... | 102/226 |
| 7,040,234 | B1 * | 5/2006 | Maurer et al. | ..... | 102/226 |
| 7,051,656 | B1 * | 5/2006 | Koehler et al. | ..... | 102/249 |
| 7,142,087 | B2 | 11/2006 | Greywall | | |
| 7,371,982 | B2 | 5/2008 | Greywall | | |
| 7,398,734 | B1 * | 7/2008 | Jean | ..... | 102/249 |
| 7,552,681 | B1 * | 6/2009 | Laib et al. | ..... | 102/254 |
| 2006/0070547 | A1 * | 4/2006 | Combes et al. | ..... | 102/222 |

OTHER PUBLICATIONS

Military Standard 1901A, MIL-STD-1901A, Munition Rocket and Missile Ignition Safety System DEsign, Safety Cirteria for DoD, Jun. 6, 2002, entirety.*

* cited by examiner

*Primary Examiner* — Bret Hayes
(74) *Attorney, Agent, or Firm* — Fredric J. Zimmerman

(57) ABSTRACT

The present disclosure provides a microelectromechanical systems (MEMS) igniter which is an ignition safety device (ISD) in a small, low-cost, low-power, and highly reliable design. The MEMS igniter provides both out-of-line safety and an ignition mechanism for a rocket motor. The igniter is initially held in a safe, out-of-line position with respect to a propellant. Upon receiving appropriate arm and fire commands and sensing the correct environment, MEMS mechanisms move an ignition component into alignment and the device can function.

8 Claims, 3 Drawing Sheets

MICROELECTROMECHANICAL SYSTEMS IGNITION SAFETY DEVICE

STATEMENT OF GOVERNMENT INTEREST

The present invention described herein may be manufactured and used by or for the Government of the United States of America for government purposes without the payment of any royalties thereon or therefor.

FIELD OF THE INVENTION

The present invention relates generally to microelectromechanical systems (MEMS). More particularly, the present invention provides systems and methods for a MEMS ignition safety device (ISD) which, provides both out-of-line safety and an ignition mechanism for a rocket motor, a propellant-operated device, or a pyrotechnic-operated device in a small, low-cost, low-power, and highly reliable and safe design.

BACKGROUND OF THE INVENTION

Ignition safety devices (ISDs) prevent an unintended functioning of a rocket motor, missile motor, or other energetic device (i.e., one that utilizes a propellant or pyrotechnic output) through an interruption of a pyrotechnic train, an interruption of a firing energy train, or the control of the energy required to arm the ISD and function the initiator. MIL-STD-1901A (June 2002) is an exemplary Design Criteria Standard for a Munition Rocket and Missile Motor Ignition System Design. This standard requires that a rocket motor initiator be either out-of-line or require greater than 500 Volts to initiate the rocket motor. Most conventional systems are either not compliant with these requirements, are inconveniently large, expensive, and/or complex. Conventional systems which are compliant with MIL-STD-1901A requirements are typically made with conventional metal parts assemblies produced by conventional precision machining and attachment.

By contrast, MEMS are miniaturized, mass-produced devices (i.e., micrometer dimensions) that may include actuators, sensors, and other mechanical structures. MEMS are typically fabricated by bulk-etching a silicon substrate or depositing layers of polysilicon, oxides, metals, and the like atop a silicon substrate. Typical MEMS actuation mechanisms include electrostatic, magnetic, and thermal. A MEMS thermal actuator is a microelectromechanical device that typically generates motion by thermal expansion amplification. A small amount of thermal expansion of one part of the device translates to a large amount of deflection of the overall device. MEMS thermal actuators are typically fabricated from doped single crystal silicon or polysilicon as a complex compliant member.

BRIEF SUMMARY OF THE INVENTION

In various exemplary embodiments, the present invention provides a MEMS igniter, which is an ignition safety device (ISD) in a small, low-cost, low-power, and highly reliable and safe design. The MEMS igniter is compliant with the design requirements of MIL-STD-1901A, June 2002. The MEMS igniter provides both out-of-line safety and an ignition mechanism for a rocket motor, other type of propellant-operated, or a pyrotechnic-operated device. The igniter is initially held in a safe, out-of-line position with respect to a propellant or other "acceptor" material, such as a pyrotechnic booster. The pyrotechnic booster functions to transfer and/or amplify the ignition output of an upstream component to a downstream component or components. Upon receiving appropriate arm and fire commands and sensing the correct environment, silicon MEMS mechanisms move an igniter component into physical alignment with the acceptor, thus allowing the device to function.

In an exemplary aspect of the present invention, an ignition safety device includes a slider including an igniter component; an arming motor connected to the slider; one or more locks; and a pyrotechnic; wherein the one or more locks are configured to engage the slider; and the arming motor is configured to move the slider to position the igniter component in-line with the pyrotechnic acceptor when the one or more locks are disengaged from the slider. The ignition safety device can include a microelectromechanical systems-based device including the slider, the arming motor, and the one or more locks. Optionally, the arming motor includes a ratcheting microelectromechanical systems actuator, and wherein one or more locks are each disengaged through a microelectromechanical systems actuator. The ratcheting microelectromechanical systems actuator and the microelectromechanical systems actuator each can include a thermal actuator. The igniter component includes a silicon bridge, wherein the silicon bridge is configured to produce a hot plasma plume in response to a pulsed high-current-density electrical current, which exceeds the burst current density for the bridge configuration. Optionally, the pyrotechnic acceptor includes boron/potassium nitrate (B/KNO3 or any energetic qualified under MIL-STD-1901A, which has been determined to be equivalently or less sensitive to inadvertent initiation stimuli than B/KNO3), and wherein the B/KNO3 is promptly ignited by the hot plasma by microconvective heat transfer, radiation, and hot particles and gases. The ignition safety device can thus be compliant with the requirements of MIL-STD-1901A.

In another exemplary aspect of the present invention, a microelectromechanical systems-based ignition safety device includes an igniter component located on a head portion of a slider; a member connected to the head portion; a ratcheting actuator connected to the member; a first lock configured to engage the head portion; a first actuator connected to the first lock; and a pyrotechnic acceptor; wherein the igniter component is out-of-line with the pyrotechnic acceptor with the first lock engaged to the head portion in a unarmed configuration; and wherein the igniter component is in-line with the pyrotechnic acceptor with the first lock disengaged from the head portion in an armed configuration. Transformation to the armed configuration from the unarmed configuration includes disengaging the first lock and moving the member and head portion with the ratcheting actuator. The microelectromechanical systems-based ignition safety device may further include a second lock configured to engage the head portion, a second actuator connected to the second lock, and a first latch connected to the second actuator. Optionally, the microelectromechanical systems-based ignition safety device further includes a third lock configured to engage the member and a third actuator connected to the third lock. The pyrotechnic acceptor could consist of a mixture of boron and potassium nitrate, wherein the B/KNO3 ignites in response to the hot plasma or other effects generated by the igniter component, which in this case is a doped polysilicon bridge, commonly known as an SCB (semiconductor bridge). Optionally, the microelectromechanical systems-based ignition safety device is compliant to MIL-STD-1901A.

In yet another exemplary aspect of the present invention, a method for providing ignition safety includes maintaining a slider with an igniter component in an out-of-line, locked position; unlocking the slider; moving the slider to position the igniter component in-line with a pyrotechnic acceptor and energizing the igniter component to ignite the pyrotechnic. The method is implemented in a microelectromechanical systems-based device. The locked position may be maintained with one or more locks (at least one lock). Optionally, the locks include thermal actuators, and the slider is moved with a thermal actuator. Ignition of the igniter component is accomplished by applying a pulsed electrical current to the igniter component's bridge in order to form a hot plasma plume.

BRIEF DESCRIPTION OF THE DRAWINGS

The present invention is illustrated and described herein with reference to the various drawings, in which like reference numbers denote like system components and/or method steps, respectively, and in which.

DETAILED DESCRIPTION OF THE INVENTION

In various exemplary embodiments, the present invention provides a MEMS igniter which is an ignition safety device (ISD) in a small, low-cost, low-power, and highly reliable and safe design. The MEMS igniter is compliant with the design requirements of MIL-STD-1901A, June 2002, the contents of which are incorporated by reference herein. The MEMS igniter provides both out-of-line safety and an ignition mechanism for a rocket motor, other type of propellant-operated, or a pyrotechnic-operated device. The igniter is initially held in a safe, out-of-line position with respect to a propellant or other "acceptor" material, such as a pyrotechnic booster. The pyrotechnic booster functions to transfer and/or amplify the ignition output of an upstream component to a downstream component or components. Upon receiving appropriate arm and fire commands and sensing the correct environment, MEMS mechanisms, such as, in an exemplary embodiment, a silicon MEMS mechanisms, move an igniter component into physical alignment with the acceptor, thus allowing the device to function.

Figure 1:
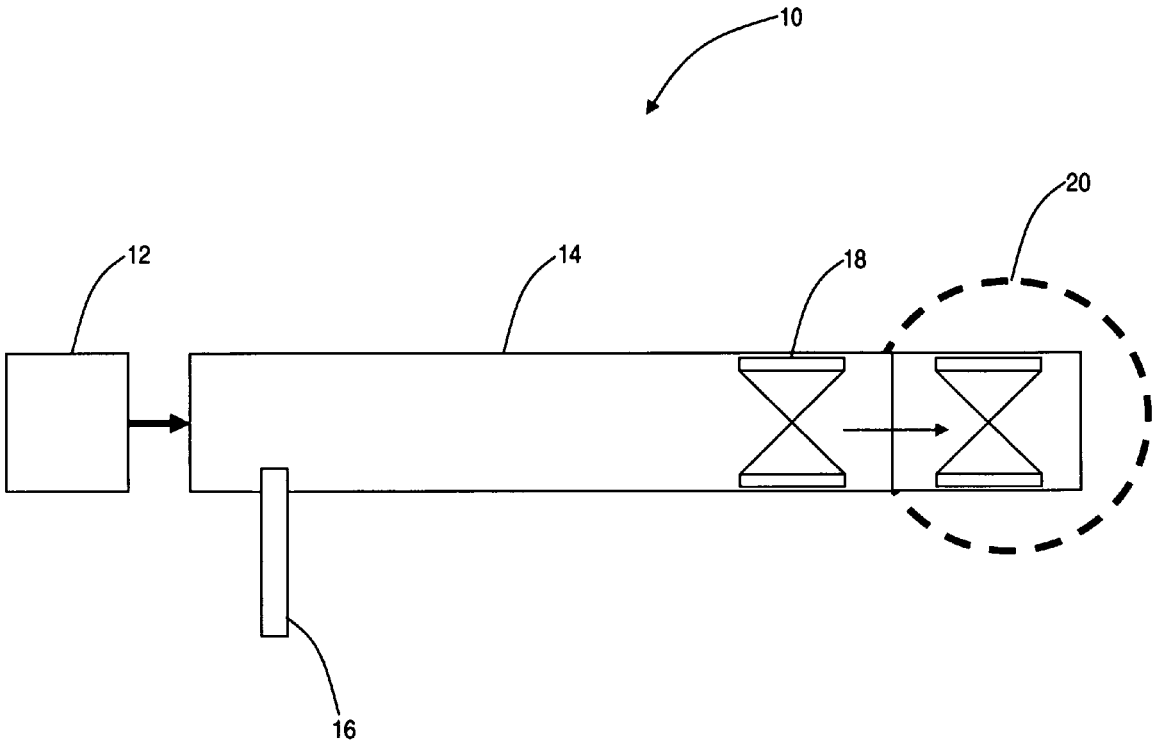
FIG. 1 is a diagram of the functional operation of a MEMS igniter according to an exemplary embodiment of the present invention.

Referring to FIG. 1, a diagram illustrates functional operation of a MEMS igniter 10 according to an exemplary embodiment of the present invention. The MEMS igniter 10 includes an arming motor 12, a slider 14, a lock 16, a silicon bridge 18, and a pyrotechnic acceptor 20. The lock 16 may be removed through an actuator (not shown), such as, for example, a MEMS thermal actuator. Additionally, the MEMS igniter 10 may include multiple locks 16. The arming motor 12 is configured to move the silicon bridge 18 along the slider 14 in line with the pyrotechnic acceptor 20. For example, the arming motor 12 may include an actuator. An electric current is applied to the silicon bridge 18 to initiate the pyrotechnic acceptor 20. The pyrotechnic acceptor 20 may include, for example, boron/potassium nitrate ($B/KNO_3$) or any energetic qualified under MIL-STD-1901A which has been determined to be equivalently or less sensitive to inadvertent initiation stimuli than B/KNO3.

The MEMS igniter 10 utilizes MEMS processes to form the doped polysilicon bridge 18 (similar to a semiconductor bridge (SCB)), which enable transformation of the bridge 18 via a high-current electrical discharge into high temperature plasma capable of igniting energetic materials, even relatively insensitive ones. Alternatively, a MEMS process could be used to form another type of bridge for the silicon bridge 18, which functions as an SJI bridge (semiconductor-junction igniter), where an electrical junction is formed that is functionally equivalent to two back-to-back zener diodes. Upon energizing this bridge at a voltage which exceeds the reverse breakdown threshold of the zener diode thus formed, the bridge is destroyed catastrophically, and erupts in a hot-plasma plume similar to that of the SCB bridge configuration. A third possibility for the bridge 18 configuration could be the use of a thin deposit of single-layer or multiple-layer metallic and non-metallic films on a silicon substrate, again produced by MEMS-compatible processes (usually vapor deposition or sputtering). These films, when heated rapidly by a fast-rising current pulse, heat ohmically, melt, and may proceed to a gas or plasma phase which serves to ignite an energetic acceptor material. Multiple layer films may be produced in which a chemical reaction commences during the melt phase, and enhance or amplify the thermochemical output provided by the bridge 18. Such reactive multi-layer films may also be placed atop an SCB or SJI type bridge in order to amplify its resultant thermal output, thus increasing the overall reliability of the ignition train.

The MEMS igniter 10 is realized utilizing MEMS device technology and fabrication techniques. Advantageously, the MEMS igniter 10 with the bridge 18 initiator (i.e., the silicon bridge 18 is an igniter component) provides a reduced size, reduced costs, and increased safety and reliability in an ignition safety device. The MEMS igniter 10 can be batch-fabricated without requiring micro-device assembly. Additionally, the MEMS igniter 10 may include various forms of MEMS actuation devices, such as thermal actuators (chevron, bent-beam, bi-morph, etc.), magnetic actuators, and the like. For example, thermal actuators can be utilized to provide the arming motor 12 and the lock 16 removal responsive to proper arming commands. MEMS manufacturing processes can produce hundreds of MEMS igniters 10 simultaneously at low cost and high reliability. The small size of the MEMS igniter 10 allows for minimal sacrifice of propellant, pyrotechnic, or warhead volume, and reduced requirements for energetics in the initiating section of the system.

The MEMS igniter 10 may utilize DRIE (deep reactive ion etched) ratchets, gears, and locks for safety features. These ratchets, gears, and locks can move the active component (i.e., the silicon bridge 18) from a safe, out-of-line position to an in-line, armed position. Instead of a primary explosive, the MEMS igniter 10 uses $B/KNO_3$, various suitable pyrotechnic formulations, eutectic metal mixtures, or an aluminothermic booster to transfer energy from the initiator device (i.e., the silicon bridge 18) to the external propellant or pyrotechnic acceptor charge.

Figure 2:
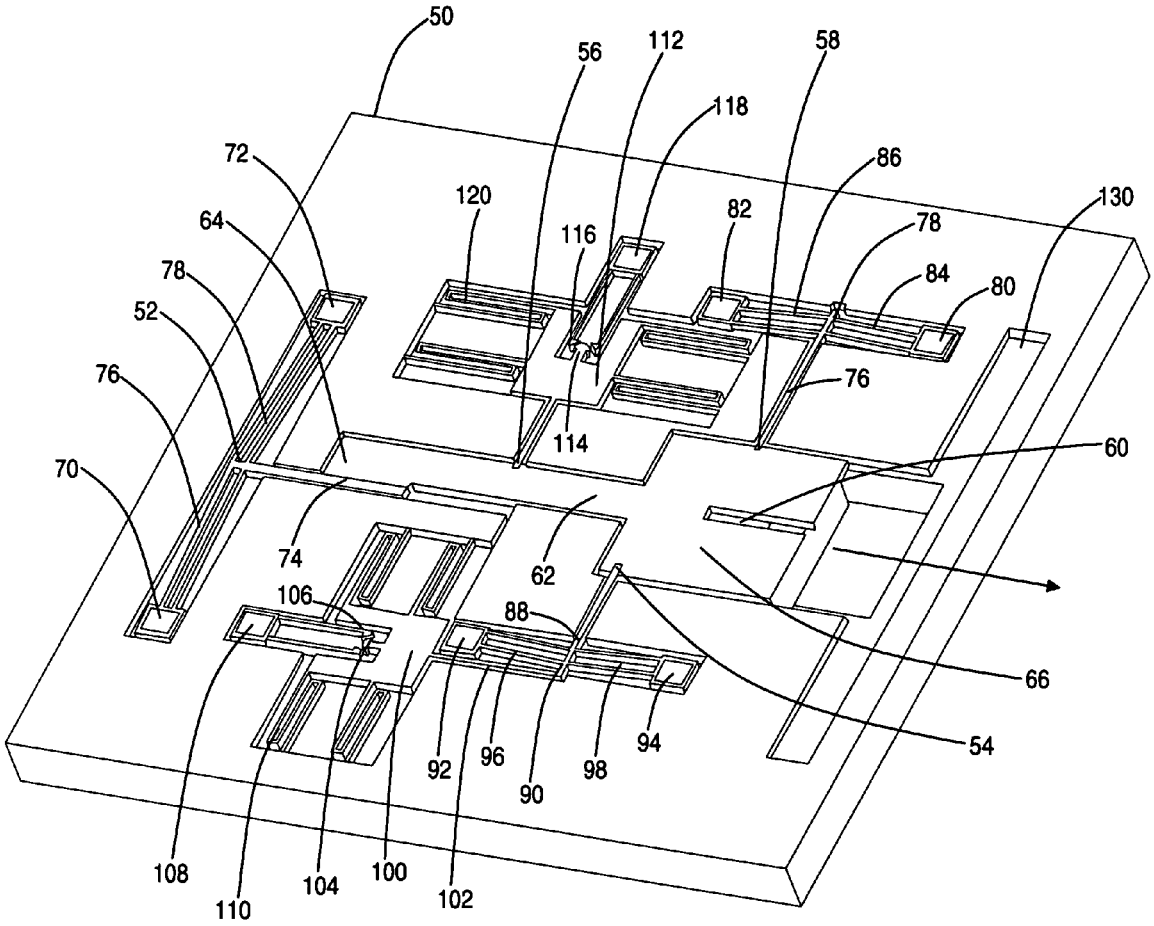
FIG. 2 is diagram of a MEMS-based ignition safety device chip according to an exemplary embodiment of the present invention.

Referring to FIG. 2, a MEMS-based ignition safety device chip 50 is illustrated according to an exemplary embodiment of the present invention. The MEMS-based ignition safety device 50 may be constructed on a silicon substrate or the like, and includes a ratcheting actuator 52, multiple locks 54, 56, 58, and an ignition component 60. The MEMS-based ignition safety device chip 50 includes a slider 62 surrounded on the chip 50 by the actuator 52 and the multiple locks 54, 56, 58. The slider 62 includes a member portion 64 connected to the ratcheting actuator 52 and a head portion 66 which is connected to the member 64 and which includes the ignition component 60. In an exemplary embodiment, the slider 62 has a substantially fork-shaped configuration.

The multiple locks 54, 56, 58 are configured to hold the slider 62 in place when the MEMS-based ignition safety device chip 50 is unarmed. For example, the lock 54 is inserted into a portion of the member and the locks 56, 58 are inserted into portions of the head portion 66. In FIG. 2, the ignition component 60 on the head portion 66 is illustrated in an electrically isolated position from the rest of the MEMS-based ignition safety device chip 50. The ignition component 60 is a layer of doped silicon or the like (configured as an SCB or SJI as described previously), which is converted into hot plasma responsive to an applied electrical current, and when in-line with a propellant, provides an ignition.

The ratcheting actuator 52 includes anchors 70, 72 connected to a yoke 74 through beams 76, 78, respectively. The yoke 74 is connected to the member 64. The anchors 70, 72 include contacts for receiving an electrical current. Responsive to an applied electrical current, the beams 76, 78 actuate forcing the yoke 74 and the member 64 forward, i.e. the ratcheting actuator 52 is a thermal actuator in this exemplary embodiment.

The lock 58 is connected to a yoke 76 of a thermal actuator 78. The yoke is connected to anchors 80, 82 through beams 84, 86, respectively. The anchors 80, 82 include contacts for receiving an electrical current, and the thermal actuator 78 is actuated responsive to the electrical current through movement of the yoke 76 based on heating of the beams 84, 86. The movement of the yoke 76 corresponds to movement of the lock 58 to disengage the lock 58 from the head portion 66.

The lock 54 also is connected to a yoke 88 of a thermal actuator 90. The yoke is connected to anchors 92, 94 through beams 96, 98, respectively. The anchors 92, 94 include contacts for receiving an electrical current, and the thermal actuator 90 is actuated responsive to the electrical current through movement of the yoke 88 based on heating of the beams 96, 98. The movement of the yoke 88 corresponds to movement of the lock 54 to disengage the lock 54 from the head portion 66.

Additionally, the lock 54 is connected to latch device 100 through a beam 102 connected to the yoke 88. The latch device 100 provides additional safety, requiring actuation of the latch device 100 in addition to the lock 54. The latch device 100 includes a notch 104 which is captured by latches 106. The latches 106 are configured to release the notch 104 responsive to an electrical current applied to an anchor 108. The latch device 100 also includes multiple springs 110 which are configured to provide force on the latch device 100 for arming the lock 54.

The lock 56 is controlled by a latch device 112 including a notch 114 which is captured by latches 116. The latches 116 are actuated responsive to an electrical current applied to an anchor 118, and the latch device 112 is connected to multiple springs 120 to provide a force of the latch device for arming the lock 56.

The MEMS-based ignition safety device chip 50 becomes armed responsive to disengaging each of the locks 54, 56, 58 and moving the ignition component 60 in-line with a pyrotechnic charge 130 through the ratcheting actuator 52. Once in-line, a specifically shaped pulse of current, at a specific voltage, and with a specific minimal rise time, is then transferred through the ignition component 60, converting its doped silicon layer through ohmic heating in the case of an SCB (or, in the case of the SJI, through catastrophic bridge breakdown and destruction) into hot plasma. The plasma ignites the propellant charge 130 in close proximity to the ignition component 60 armed position. The pyrotechnic charge 130, such as $B/KNO_3$ or any energetic qualified under MIL-STD-1901A, which has been determined to be equivalently or less sensitive to inadvertent initiation stimuli than $B/KNO_3$, may be fabricated apart from the MEMS-based ignition safety device chip 50 and assembled in the final package. This charge may be pressed or deposited by ink-jet printing as a slurry into the MEMS-based ignition safety device chip 50 (i.e., plasma ejected downwards) or be part of the overall packaging (i.e., plasma ejected upwards from the top surface of the overall MEMS-based ignition safety device chip 50).

The various anchors in FIG. 2 include contacts that may extend through wires or the like off of the MEMS-based ignition safety device chip 50. This configuration enables current to be applied to the MEMS-based ignition safety device chip 50 for arming and firing the MEMS-based ignition safety device chip 50. Several approaches may be used, but they all have extended wires that contact different portions of the MEMS-based ignition safety device chip 50 and form the electrical path. In an inverted design, the wires could be moved into contact with a stationary, isolated ignition component structure by similar actuation as the shown in the MEMS-based ignition safety device chip 50.

In an exemplary embodiment, the chip dimensions for the MEMS-based ignition safety device chip 50 are 9 millimeters by 9 millimeters, but other sizes can be realized with, for instance, fewer locks 54, 56, 58 and/or shorter out-of-line to in-line travel of components 64, 66. The orientation of the pyrotechnic charge 130 may be centered or off to one side. The locks 54, 56, 58 ignition component featured above rely on launch forces for release. Command locks released by a signal from the external electronics could be used instead. Also, in final assembly, a removable pin of several millimeters diameter could be inserted into an etched hole in the MEMS-based ignition safety device chip 50 (not shown) to prevent its travel. The pin could be positioned by an aligned opening in a sealing cap layer. This cap layer may be necessary in all cases to prevent dust from achieving the result of a deliberately inserted pin.

Advantageously, the MEMS-based ignition safety device chip 50 provides an out-of-line igniter design. When the locks 54, 56, 58 are engaged and the ignition component 60 is out-of-line, the MEMS-based ignition safety device chip 50 has the ability to withstand more than 500 volts applied to any two leads. If the MEMS-based ignition safety device chip 50 uses pyrotechnic material for the pyrotechnic charge 130 that complies with MIL-STD-1901A, the MEMS-based ignition safety device chip 50 provides a compliant design.

This low cost, highly reliable approach uses proven MEMS manufacturing with thin film initiation and physically separated electrical pathways to satisfy these requirements. The ignition component 60 element cannot be functioned until it is in the armed position and physically connected to the firing electrical pathway. Until it is moved by the actuator 52 fully into the armed position, it is electrically and physically isolated. Even if it were somehow functioned prior to arming, the out-of-line position would prevent transfer to the pyrotechnic charge 130 and simply dud the MEMS-based ignition safety device chip 50.

Those of ordinary skill in the art will recognize that the present invention can include various types of actuators, sliders, electrical contacts, materials and packaging schemes, each of which is contemplated by the present invention. The actuators may be driven by thermal, piezoelectrical, electrostatic, etc. mechanisms. Contacting electrical "wires" can be pointed, wall-to-wall, extended beams, etc. In addition to silicon, the present invention could be constructed with plastic, glass, metal (with appropriate insulating materials), ceramics, etc.

The ignition component 60 design may be tailored for energy requirements or output levels/size by changing the shape and area of the metal to be turned to plasma. This metallic layer can be gold, aluminum, copper, silver, etc. There could also be several layers of material. In some cases, the metal could be replaced by semiconducting material or any other material that can be converted to plasma. The pyrotechnic charge could be any other approved energetic, including monomolecular explosives.

The sealing cap may be formed from various materials, including metal, glass, ceramic, etc. The packaging could be molded plastic, high temperature co-fired ceramic (HTCC), low temperature co-fired ceramic (LTCC), metal, glass, etc. Electrical connections can be strip line, wire-bonded, bump bonded, soldered, etc. As noted above, the safety locks 54, 56, 48 can be removed by physical means, integrated as part of the package, electrically commanded, etc. Their design is dependent upon the criteria for a particular application.

Figure 3:
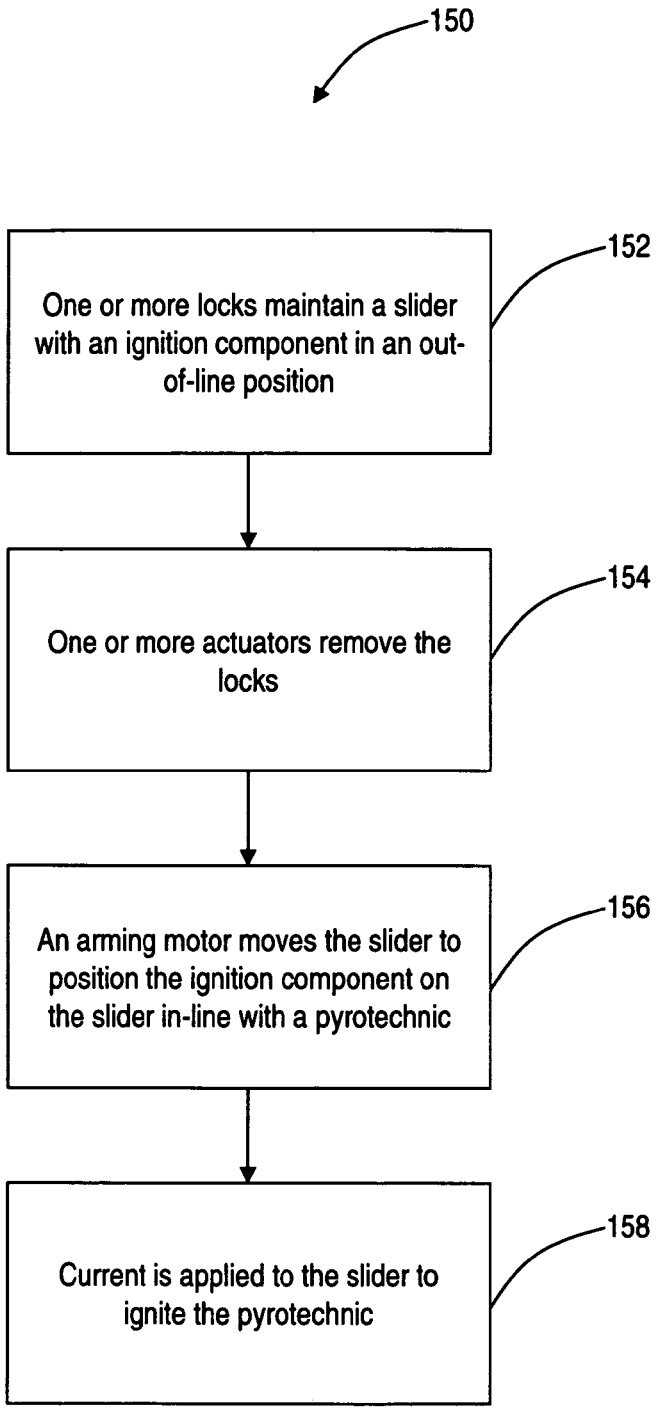
FIG. 3 is a flowchart of an exemplary operation of a MEMS-based ignition safety device according to an exemplary embodiment of the present invention.

Referring to FIG. 3, a flowchart illustrates an exemplary operation 150 of a MEMS-based ignition safety device according to an exemplary embodiment of the present invention. As described herein, the present invention provides a MEMS-based ignition safety device which is maintained in an out-of-line configuration when unarmed. This status may be accomplished through MEMS-based multiple locks. The one or more locks maintain a slider with an ignition component in an out-of-line position when the device is unarmed (step 152).

Upon receiving the appropriate commands and sensing the appropriate conditions, one or more actuators remove the locks (step 154). An arming motor moves the slider to position the ignition component on the slider in-line with a pyrotechnic (step 156). Finally, a current is applied to the slide to ignite the pyrotechnic (step 158). For example, the ignition can include the various mechanisms described herein.

The present invention may be utilized in a variety of applications in addition to acting as an ignition safety device (ISD) for a rocket or missile motor. For example, the present invention could be used as a smart airbag initiator in automobiles, as an ISD for large flares or fireworks, for avalanche control shells, and the like. The present invention is designed with reduce size, weight, and cost compared to conventional solutions. The MEMS-based manufacturing enables a simple fabrication sequence for increased reliability. Also, the present invention may utilize standard MEMS-based processes, avoiding exotic chemicals or processes. By virtue of its small size, the quantities of sensitive or toxic energetic materials of all types are minimized.

Although the present invention has been illustrated and described herein with reference to exemplary embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An ignition safety device, comprising:

a slider comprising an igniter component;

an arming motor being connected to the slider;

at least one lock; and a pyrotechnic acceptor, wherein said at least one lock is configured to engage the slider, wherein the arming motor is configured to move the slider to position the igniter component in line with the pyrotechnic acceptor when said at least one lock is disengaged from the slider, wherein the ignition safety device comprises a microelectromechanical systems-based device, which comprises the slider, the arming motor, and said at least one lock, wherein the igniter component comprises a silicon bridge, and wherein the silicon bridge comprises a doped silicon bridge configured to discharge into high temperature plasma capable of igniting energetic materials responsive to an electrical current.

2. The ignition safety device of claim 1, wherein the arming motor comprises a ratcheting microelectromechanical systems actuator, and wherein said at least one lock is each disengaged through a microelectromechanical systems actuator.

3. The ignition safety device of claim 1, wherein the arming motor comprises a ratcheting microelectromechanical systems actuator, wherein said at least one lock is each disengaged through a microelectromechanical systems actuator, and wherein the ratcheting microelectromechanical systems actuator and the microelectromechanical systems actuator each comprise a thermal actuator.

4. The ignition safety device of claim 1, wherein the igniter component comprises a silicon bridge, and wherein the silicon bridge is configured to produce a hot plasma plume in response to a pulsed high-current-density electrical current which exceeds a burst current density for the silicon bridge.

5. The ignition safety device of claim 1, wherein the pyrotechnic acceptor comprises boron/potassium nitrate, and wherein boron/potassium nitrate is ignited by the hot plasma through microconvective heat transfer, radiation, and hot particles and gases.

6. The ignition safety device of claim 1, wherein the ignition safety device is compliant with the requirements of MIL-STD-1901A, and wherein the pyrotechnic acceptor comprises an energetic qualified under MIL-STD-1901A with a sensitivity, at most, to inadvertent initiation stimuli rather than boron/potassium nitrate.

7. An ignition safety device, comprising:

a slider comprising an igniter component;

an arming motor being connected to the slider;

at least one lock; and a pyrotechnic acceptor, wherein said at least one lock is configured to engage the slider, wherein the arming motor is configured to move the slider to position the igniter component in line with the pyrotechnic acceptor when said at least one lock is disengaged from the slider, wherein the ignition safety device comprises a micro-electromechanical systems-based device, which comprises the slider, the arming motor, and said at least one lock, wherein the igniter component comprises a silicon bridge, wherein the silicon bridge comprises a thin deposit on a silicon substrate, wherein the thin deposit is selected from one of a single-layer film and multiple-layer metallic and non-metallic films, and wherein the thin deposit heat ohmically responsive to a fast-rising current pulse and convert to one of a gas and plasma phase, which serves to ignite an energetic acceptor material.

8. An ignition safety device, comprising:

a slider comprising an igniter component;

an arming motor being connected to the slider;

at least one lock; and a pyrotechnic acceptor, wherein said at least one lock is configured to engage the slider, wherein the arming motor is configured to move the slider to position the igniter component in line with the pyrotechnic acceptor when said at least one lock is disengaged from the slider, wherein the ignition safety device comprises a micro-electromechanical systems-based device comprising the slider, the arming motor, and said at least one lock, wherein the igniter component comprises a silicon bridge, wherein the silicon bridge comprises a semiconductor-junction igniter comprising an electrical junction functionally equivalent to two back-to-back zener diodes, and wherein upon energizing the semiconductor-junction igniter at a voltage which exceeds a reverse breakdown threshold of the zener diodes, the semiconductor-junction igniter is destroyed catastrophically erupting in a hot-plasma plume.

* * * * *